US009963286B2

(12) United States Patent
Corvisier

(10) Patent No.: US 9,963,286 B2
(45) Date of Patent: May 8, 2018

(54) PROTECTIVE PACKAGING IN WHICH WINE BOTTLES CAN BE TRANSPORTED

(71) Applicant: JF Hillebrand Limited, Dublin (IE)

(72) Inventor: Pierre Corvisier, Beaune (FR)

(73) Assignee: JF HILLEBRAND LIMITED, Dublin (IE)

( * ) Notice: Subject to any disclaimer, the term of this patent is extended or adjusted under 35 U.S.C. 154(b) by 97 days.

(21) Appl. No.: 14/877,086

(22) Filed: Oct. 7, 2015

(65) Prior Publication Data

US 2016/0272403 A1 Sep. 22, 2016

(30) Foreign Application Priority Data

Mar. 18, 2015 (GB) ..... 1504555.2

(51) Int. Cl.
*B65D 81/113* (2006.01)
*B65B 21/02* (2006.01)
*B65D 25/10* (2006.01)

(52) U.S. Cl.
CPC ..... *B65D 81/113* (2013.01); *B65B 21/02* (2013.01); *B65D 25/103* (2013.01)

(58) Field of Classification Search
CPC .. B65D 81/133; B65D 25/103; B65D 81/113; B65B 21/02
USPC .... 206/486, 490, 485, 485.1, 378, 376, 806, 206/6.1, 427–435; 248/613
See application file for complete search history.

(56) References Cited

U.S. PATENT DOCUMENTS 1,960,279 A 5/1934 Read
1,967,026 A 7/1934 Gray
2,962,156 A * 11/1960 Adams ..... A45C 11/16 206/559
4,341,308 A * 7/1982 Pasquini ..... B65D 5/5042 206/427
5,273,154 A * 12/1993 Braun ..... A45C 11/16 206/495
5,950,829 A * 9/1999 Gale ..... B65D 81/133 206/433

(Continued)

FOREIGN PATENT DOCUMENTS

FR 684 094 6/1930
FR 1 205 747 2/1960

(Continued)

*Primary Examiner* — Chun Cheung
(74) *Attorney, Agent, or Firm* — Stephen J. Weyer; Stites & Harbison PLLC

(57) ABSTRACT

A protective structure for protecting bottles, particularly wine bottles, comprises a first pair of elements (10) which are spaced apart horizontally. The elements have recesses (12, 14) in their upper surfaces for receiving bottles. There is a second pair of elements inverted with respect to the first pair and having recesses in their lower edges. The recesses of the second pair of elements register with the recesses of the first pair of elements so as to define circular bottle receiving openings. A ring of cushioning material lines each opening. The cushioning material is in the form of semi-circular strips, the strips of registering recesses forming a ring, or in the form of a complete ring. Each ring includes a web (24) which lies against the semi-circular faces (20, 22) of the recesses (12, 14) and flanges (26) which lie against the side faces of the elements (10).

4 Claims, 5 Drawing Sheets

(56) References Cited

U.S. PATENT DOCUMENTS

| | | | | |
|---|---|---|---|---|
| 6,322,034 | B1 * | 11/2001 | O'Malley | B65D 19/44 248/346.02 |
| 6,474,473 | B2 * | 11/2002 | Wong | B65D 5/5021 206/427 |
| 6,820,743 | B2 | 11/2004 | Hurley et al. | |
| 7,237,675 | B2 | 7/2007 | O'Malley | |
| 8,240,474 | B1 * | 8/2012 | Mossberg | B65D 81/025 206/449 |
| 8,376,136 | B2 * | 2/2013 | Arai | B65D 5/5057 206/419 |
| 2004/0031711 | A1 * | 2/2004 | O'Malley | B65D 81/133 206/427 |

FOREIGN PATENT DOCUMENTS

| | | |
|---|---|---|
| FR | 1268153 | 7/1961 |
| FR | 2 155 005 | 5/1973 |
| FR | 2 967 401 | 5/2012 |
| GB | 11119 | 12/1898 |
| GB | 870704 | 6/1961 |

* cited by examiner

PROTECTIVE PACKAGING IN WHICH WINE BOTTLES CAN BE TRANSPORTED

FIELD OF THE INVENTION

THIS INVENTION relates to protective packaging in which wine in bottles can be transported.

BACKGROUND TO THE INVENTION

The generally accepted way of packaging wine for transportation is to provide an outer box, often of corrugated board, and internal partitions for separating the bottles from one another. In the simplest form the partitions comprise a number of vertical, transverse and longitudinal elements which intersect one another to form a plurality of vertically elongate compartments. A bottle stands in each compartment which is bounded either by four intersecting boards or by a number of boards and the inner surface of the carton.

In more complex packaging the bottles lie horizontally in moulded trays which are shaped to cradle the bottles and prevent movement. Examples of this type of packaging are disclosed in the following specifications:—

| | |
|---|---|
| U.S. Pat. No. 6,820,743 | Hurley |
| French Specification 2,155,005 | Papeteries |
| U.S. Pat. No. 7,237,675 | O'Malley |
| French Specification 1,205,747 | Blanch |
| U.S. Pat. No. 1,967,026 | Gray |
| U.S. Pat. No. 1,960,279 | Read |
| UK Specification 870,704 | Blanch |

It is also known to provide the internal surfaces of the walls of a rigid box, for example of wood, with blind slots for receiving and supporting the free end of the neck and also the base of the bottle. An example of this type of packaging is found in French specification 2 967 401.

In the form described in French specification 1,268,153 (Cucurull) the carton has hard, internal, vertical partitions with semi-circular recesses in their top edges. There are smaller recesses for supporting the bottle necks and larger recesses for the main cylindrical parts of the bottles.

The partitions is covered by a corrugated, resilient sheet which initially extends across the upwardly open mouths of the recesses. When a bottle neck or base is inserted into a recess from above, the sheet is pressed into the recess by the bottle base or bottle neck so that it forms a cushion between the bottle and the partition.

Parts of the sheet lie against the sides of the partition and edge zones are secured to the base of the carton in which the partition is used. End tabs of the sheet are secured to the internal surfaces of opposed walls of the carton.

Much labour is required to cut the flexible corrugated sheet to shape, secure it to the hard partition and then secure it to the carton's base and walls.

The partition is fixed in the carton and no adjustment along the carton is possible after the sheet has been secured to the carton.

In French Specification 684094 there is disclosed a preformed support which defines a row of upwardly open recesses for receiving the necks of the bottles. In one disclosed form the support is sinusoidal in section so that upwardly facing and downwardly facing recesses are formed.

U.S. Pat. No. 4,341,308 discloses supports which have alternating large and small recesses in the upper edges thereof for receiving a row of bottles which are in reversed positions with respect to one another.

Specification GB 11,119 of 1898 discloses a packing case in which horizontally extending upper and lower partitions are provided for supporting bottles which are positioned vertically and upside down and pass through holes in the partitions. The holes of the lower partition each have a lining therein. Each lining comprises a sleeve in the hole in the partition and a flange which lies against the top face of the partition. The bottles are supported by the linings. The weight of each bottle presses the flange of the lining on which it bears against the top face of the partition.

The liquid in bottles which are vertical and inverted exerts a greater pressure on the bottle's seal than it does if the bottle is upright or is lying horizontally. The greater pressure that is exerted increases the possibility of leakage occurring.

To avoid this problem the case of specification 11119 could be used with the bottles horizontal. However, in such circumstances the vibrations and shocks to which the case is inevitably exposed could shake the lining out of the holes in the partitions as there is only one flange. This has the result that there can then be direct contact between the bottle and the hard partition should the case subsequently be subjected to shocks or impacts.

The present invention provided an improvement to the protective packaging disclosed in the specifications discussed and in particular an improvement in the packing case of UK specification 11,119.

BRIEF DESCRIPTION OF THE INVENTION

According to one aspect of the present invention there is provided a protective structure for protecting bottles, particularly wine bottles, which comprises a first pair of elements which are spaced apart horizontally, the elements having recesses in their upper surfaces for receiving bottles, a second pair of elements inverted with respect to the first pair and having recesses in their lower edges, the recesses of the second pair of elements registering with the recesses of the first pair of elements so as to define circular bottle receiving openings, and a ring of cushioning material lining each opening, each ring including a web which lies against the semi-circular faces of the recesses constituting that opening and flanges which lie against the side faces of said elements.

The cushioning material can be in the form of semi-circular strips, the strips of registering recesses forming a ring.

Alternatively the cushioning material can be in the form of rings which are placed around the bottles and lie half in one recess of each registering pair of recesses and half in the other.

According to a further aspect of the present invention there is provided a partition for use in a carton to support and locate wine bottles, the partition comprising an elongate element of a material capable of supporting the weight of a plurality of wine bottles, the element having side faces and semi-circular recesses in the top edge thereof, each recess having therein a strip of cushioning material which is of semi-circular form and includes a web which covers the semi-cylindrical face of the recess and flanges which lie against the side faces of said element.

Preferably some of the recesses are sized to receive the necks of bottles lying horizontally and others are of larger size to receive the cylindrical parts of bottles lying horizontally.

To avoid them being displaced, the strips can be adhered to the element.

According to another aspect of the present invention there is provided a method of assembling a structure which protects bottles during shipping and which method comprises:— providing a carton;

standing a pair of horizontally spaced elongate elements on the base of the carton, each element having semi-circular recesses in its upper edge;

placing a ring of cushioning material around the main cylindrical part of each bottle and a further cushioning ring around the neck of each bottle, each ring comprising two flanges joined by a web;

placing the bottles on the partitions with the webs of the rings against the semi-cylindrical surfaces of the recesses and the flanges against the side surfaces of the elements; and placing a further pair of partitions, inverted with respect to the first pair and having recesses in their lower edges, onto the bottles so that the recesses register to form circular openings which are lined by said rings.

BRIEF DESCRIPTION OF THE DRAWINGS

For a better understanding of the present invention, and to show how the same may be carried into effect, reference will now be made, by way of example, to the accompanying drawing in which.

DETAILED DESCRIPTION OF THE DRAWINGS

Figure 1:
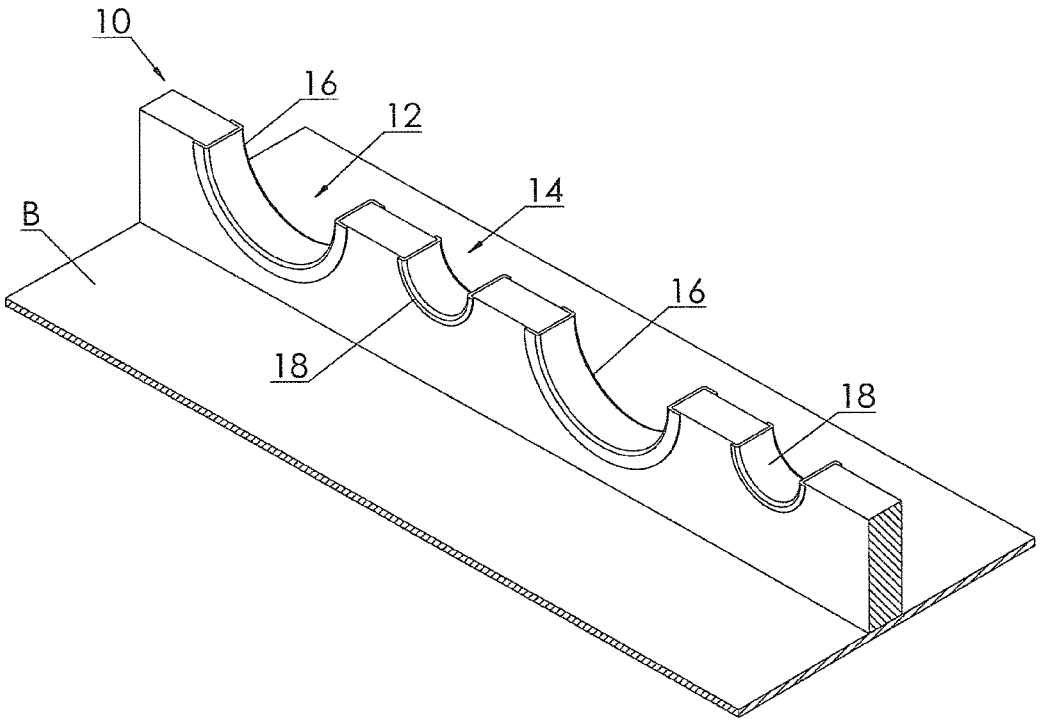
FIG. 1 is a pictorial view of a partition for locating and supporting wine bottles in a carton.
Figure 2:
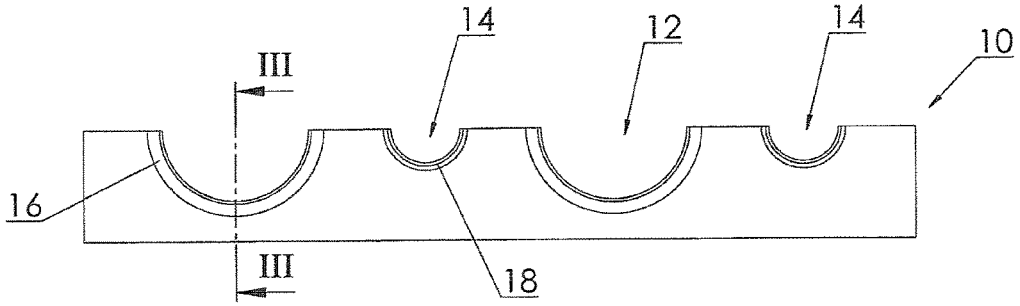
FIG. 2 is an elevation of the partition of FIG. 1.

The wine bottle supporting and locating partition shown in FIGS. 1 and 2 is designated 10 and is in the form of an elongate plank. The partition is preferably of wood but can be moulded using synthetic plastics material. The partition 10 stands on, but is not secured to, the base B of the carton.

In the top edge of the partition 10 there are recesses 12 and 14. The recesses 12 are larger than the recesses 14. Each recess 12 receives the cylindrical main part of a bottle that is placed onto the partition from above. The recesses 14 receive the necks of bottles which are supported by the partition but in a reversed position.

A second partition, not shown, spaced from the partition 10 along the base B has its recesses 12, 14 reversed with respect to those of the partition 10. Thus each of the second partition's recesses 12 is aligned with one of the recesses 14 of the partition 10 and each of the second partition's recesses 14 is aligned with one of the recesses 12 of the partition 10. Thus each bottle is supported at two places along its length by the two spaced partitions.

Cushioning strips 16, 18 of rubber or synthetic plastics material are adhered to the semi-circular bounding surfaces 20, 22 (FIG. 4) of the recesses 12, 14 respectively. The strips 16, 18 extend the full length of each semi-circular surface 20, 22.

Figure 3:
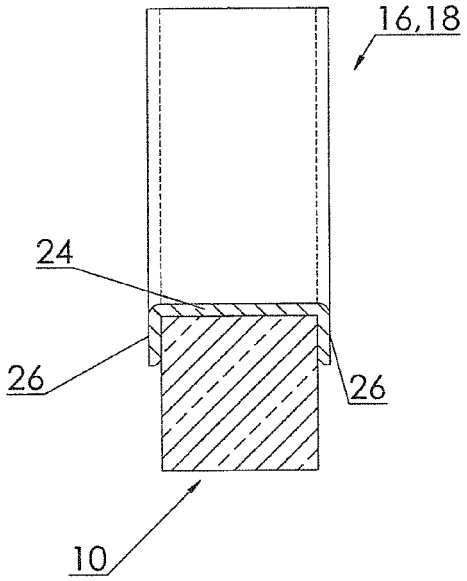
FIG. 3 is a section on the line III-III of FIG. 2.

Each strip 16, 18, see FIG. 3, comprises a web 24 and flanges 26 along the edges of the web 24. The strips 16, 18 are thus channel shaped in section. The web 24 is adhered to the curving semi-circular surfaces 20, 22 and the flanges 26 to the flat surfaces of the element constituting partition 10 immediately adjacent the recesses 12, 14.

A further partition, inverted with respect to the partition as shown in FIG. 2, but with its recesses 12, 14 in the same position, is placed on the partition 10. The strips 16, 18 of the partitions form complete rings which encircle the necks of the bottles and their main cylindrical parts close to their bases.

The material used for the strips is soft and compressible and absorbs any shocks to which the carton might be subjected, thus protecting the bottles from damage. By absorbing shock energy, the strips also assist in protecting the partitions from damage.

Figure 5:
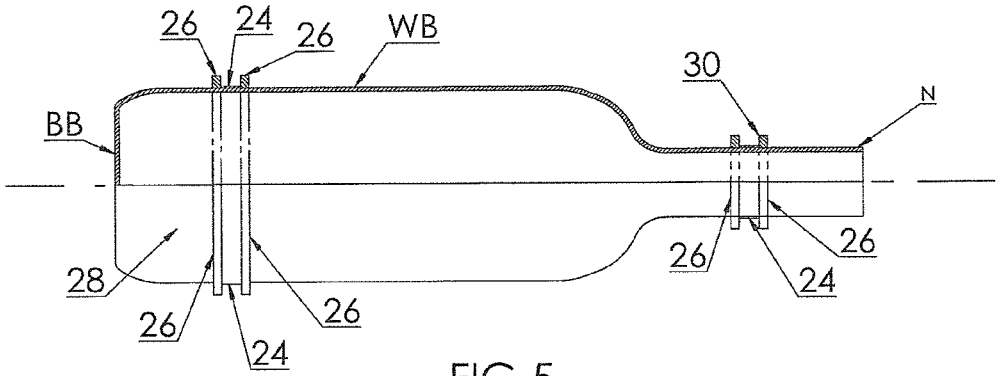
FIG. 5 illustrates a wine bottle with protective rings fitted to it.

Turning now to FIG. 5 this shows a wine bottle WB. The upper half of the drawing shows the bottle in section and the lower half is an elevation.

A ring 28 of the same material and of the same cross-section shape as the strips 16, 18 encircles the bottle WB close to its base BB. A further ring 30, identical to the ring 28 but of smaller diameter, encircles the bottles' neck N. The rings 28, 30 have webs 24 and flanges 26 of the same configuration as the strips 16, 18.

Figure 4:
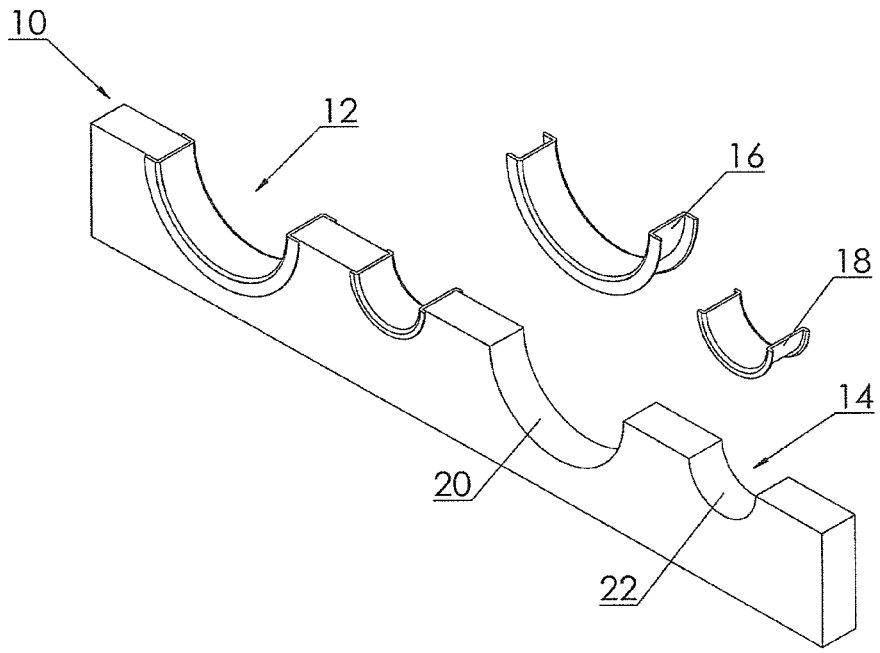
FIG. 4 is a partially "exploded" pictorial view of the partition.

The bottle WB encircles by the rings 28, 30 is placed on two partition of the form shown in the right hand part of FIG. 4, that is, onto partitions with recesses 12, 14 but without strips 16, 18 in them. The ring 28 enters the recess 12 of a first partition and the flanges 26 take up positions against the side surfaces of the plank constituting the main part of the partition. The web 24 is against the surface 20. Similarly, the ring 30 enters one of the recesses 14 of a second partition which is spaced horizontally from the first partitions.

Bottles are placed in all the recesses 12 and 14 of the two partitions. Two further partitions, inverted with respect to those on which the bottles have been placed, are located so that their downwardly facing recesses 12, 14 register with the upwardly facing recesses 12, 14 of the partitions supporting the bottles. The sets of recesses thus form circular openings in which the rings 28, 30 are located.

The material of the rings, in addition to being soft and compressible, preferably is also tensile so that it has the ability to stretch. Rings fabricated of a diameter for one size of bottle can be stretched and placed around a bottle of a larger size, and then used with a partition the recesses 12, 14 of which are also of a larger diameter. This reduces the number of ring sizes that are required.

The invention claimed is:

1. A protective structure for protecting bottles, particularly wine bottles, which comprises a first pair of elements which are spaced apart horizontally, the elements having recesses in their upper surfaces for receiving bottles, a second pair of elements inverted with respect to the first pair and having recesses in their lower edges, the recesses of the second pair of elements registering with the recesses of the first pair of elements so as to define circular bottle receiving openings, and a ring of cushioning material lining each opening, each ring including a web which lies against semi-circular faces of the recesses constituting that opening and flanges which lie against side faces of said elements.

2. A structure as claimed in claim 1, wherein the cushioning material is in the form of semi-circular strips, the strips of registering recesses forming a ring.

3. A structure as claimed in claim 1, wherein the cushioning material is in the form of rings which are placed around the bottles and lie half in one recess of each registering pair of recesses and half in the other.

4. A method of assembling a structure which protects bottles during shipping and which method comprises:

providing a carton;

standing a pair of horizontally spaced elongate elements on the base of the carton, each element having semi-circular recesses in its upper edge;

placing a ring of cushioning material around the main cylindrical part of each bottle and a further cushioning ring around the neck of each bottle, each ring comprising two flanges joined by a web;

placing the bottles on the partitions with the webs of the rings against the semi-cylindrical surfaces of the recesses and the flanges against the side surfaces of the elements; and placing a further pair of partitions, inverted with respect to the first pair and having recesses in their lower edges, onto the bottles so that the recesses register to form circular openings which are lined by said rings.

* * * * *